US009541872B2

(12) United States Patent
Takahashi

(10) Patent No.: US 9,541,872 B2
(45) Date of Patent: Jan. 10, 2017

(54) FIXING DEVICE HAVING FIXING BELT HEATED WITH RADIANT HEAT FROM HEAT GENERATING PORTION AND IMAGE FORMING APPARATUS INCLUDING SAME

(71) Applicant: KYOCERA Document Solutions Inc., Osaka (JP)

(72) Inventor: Hironori Takahashi, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 15/090,106

(22) Filed: Apr. 4, 2016

(65) Prior Publication Data

US 2016/0334741 A1 Nov. 17, 2016

(30) Foreign Application Priority Data

May 15, 2015 (JP) ..... 2015-100317

(51) Int. Cl.
*G03G 15/20* (2006.01)

(52) U.S. Cl.
CPC ..... *G03G 15/2053* (2013.01)

(58) Field of Classification Search
CPC ..... G03G 15/2053
USPC ..... 399/329; 219/216
See application file for complete search history.

(56) References Cited

U.S. PATENT DOCUMENTS 4,780,078 A * 10/1988 Masui ..... G03G 15/2053 219/216
8,135,292 B2 * 3/2012 Chang ..... G03G 15/2042 399/33
2006/0289418 A1 * 12/2006 Konishi ..... G03G 15/2007 219/216
2012/0155936 A1 6/2012 Yamaguchi et al. ..... 399/329
2015/0104227 A1 * 4/2015 Shimokawa ..... G03G 15/2053 399/329

FOREIGN PATENT DOCUMENTS

JP 2012-128219 A 7/2012

* cited by examiner

*Primary Examiner* — Quana M Grainger
(74) *Attorney, Agent, or Firm* — Stein IP, LLC

(57) ABSTRACT

A fixing device includes an endless-shaped fixing belt, a heater, a holding member, and a pressure member. The heater has a heat generating portion, and a seal portion that seals each end of the heat generating portion. The heater heats the fixing belt from inside the fixing belt with radiant heat. The holding member is disposed inside the fixing belt and slides against an inner circumferential surface of the fixing belt. The pressure member is pressed with a predetermined pressure against the holding member with the fixing belt therebetween, and thereby a fixing nip portion is formed between the pressure member and the fixing belt. An end-portion excessive temperature increase prevention member that blocks radiant heat is attached to each end portion of the heater. A first opening portion is formed in such part of the end-portion excessive temperature increase prevention member as faces the seal portion of the heater.

5 Claims, 7 Drawing Sheets

FIXING DEVICE HAVING FIXING BELT HEATED WITH RADIANT HEAT FROM HEAT GENERATING PORTION AND IMAGE FORMING APPARATUS INCLUDING SAME

INCORPORATION BY REFERENCE

This application is based upon and claims the benefit of priority from the corresponding Japanese Patent Application No. 2015-100317 filed on May 15, 2015, the entire contents of which are incorporated herein by reference.

BACKGROUND OF THE INVENTION

The present disclosure relates to a fixing device for use in image forming apparatuses such as a copier, a printer, a facsimile, and a multifunction peripheral having these functions, and to an image forming apparatus including the same. In particular, the present disclosure relates to a fixing device that employs a belt fixing method in which a sheet carrying an unfixed toner image thereon is passed through a fixing nip portion, which is formed by a heated fixing belt and a pressure member, and unfixed toner is heated and melted to be fixed on the sheet.

For conventional image forming apparatuses employing the electro-photographic method, there has been developed a belt fixing method in which, instead of a heating roller, an endless fixing belt that absorbs radiant heat from a heat source to liberate heat is employed as a heating member for heating a sheet. According to the belt fixing method, a sheet carrying an unfixed toner image is passed through a fixing nip portion formed by the heated fixing belt and a pressure member, which is pressed against the fixing belt, and thereby toner is fixed onto the sheet.

With the belt fixing method, it is possible to reduce thermal capacity and shorten a warm-up period to thereby reduce power consumption, as compared with a case of adopting a heat roller fixing method in which at least one of a pair of fixing rollers forming a fixing nip portion is used as a heating roller, and a sheet carrying an unfixed toner image is passed through the fixing nip portion to thereby fix toner onto the sheet.

For example, there is known a fixing device that includes a fixing member that is a rotatable endless belt, a pressure member so disposed on an outer circumferential side of the fixing member as to be able to be pressed against the fixing member, a nip forming member that is disposed at an inner circumferential side of the fixing member, that is formed of a base member and a sliding sheet wound around the base member, and that is pressed against the pressure member via the fixing member to form a nip portion, a reinforcement member fixed to an inner diameter portion of the fixing member to support the nip forming member from a side opposite to the nip portion, a substantially cylindrical support member fixed to the inner circumferential side of the fixing member such that an outer circumferential surface of the support member is in slide contact with an inner circumferential surface of the fixing member to support rotation of the fixing member, and heating means that is disposed inside the cylindrical support member and heats the support member.

SUMMARY

According to an aspect of the present disclosure, a fixing device includes a fixing belt, a heater, a holding member, and a pressure member. The fixing belt is endless shaped and circularly movable at a speed substantially equal to a recording medium conveying speed. The heater is disposed inside the fixing belt and heats the fixing belt with radiant heat. The holding member is disposed inside the fixing belt and slides against an inner circumferential surface of the fixing belt. The pressure member is pressed with a predetermined pressure against the holding member with the fixing belt therebetween, and thereby a fixing nip portion is formed between the pressure member and the fixing belt. A recording medium carrying an unfixed toner image thereon is passed through the fixing nip portion, and thereby, the toner image carried on the recording medium is fixed. The heater has a heat generating portion in which a filler gas and a filament are sealed, and a seal portion that seals each end of the heat generating portion. To each end portion of the heater, an end-portion excessive temperature increase prevention member is attached that blocks transfer of radiant heat toward each end portion of the fixing belt in a widthwise direction of the fixing belt. A first opening portion is formed in such part of the end-portion excessive temperature increase prevention member as faces the seal portion of the heater.

Still other objects and specific advantages of the present disclosure will become apparent from the following descriptions of preferred embodiments.

DETAILED DESCRIPTION

Figure 1:
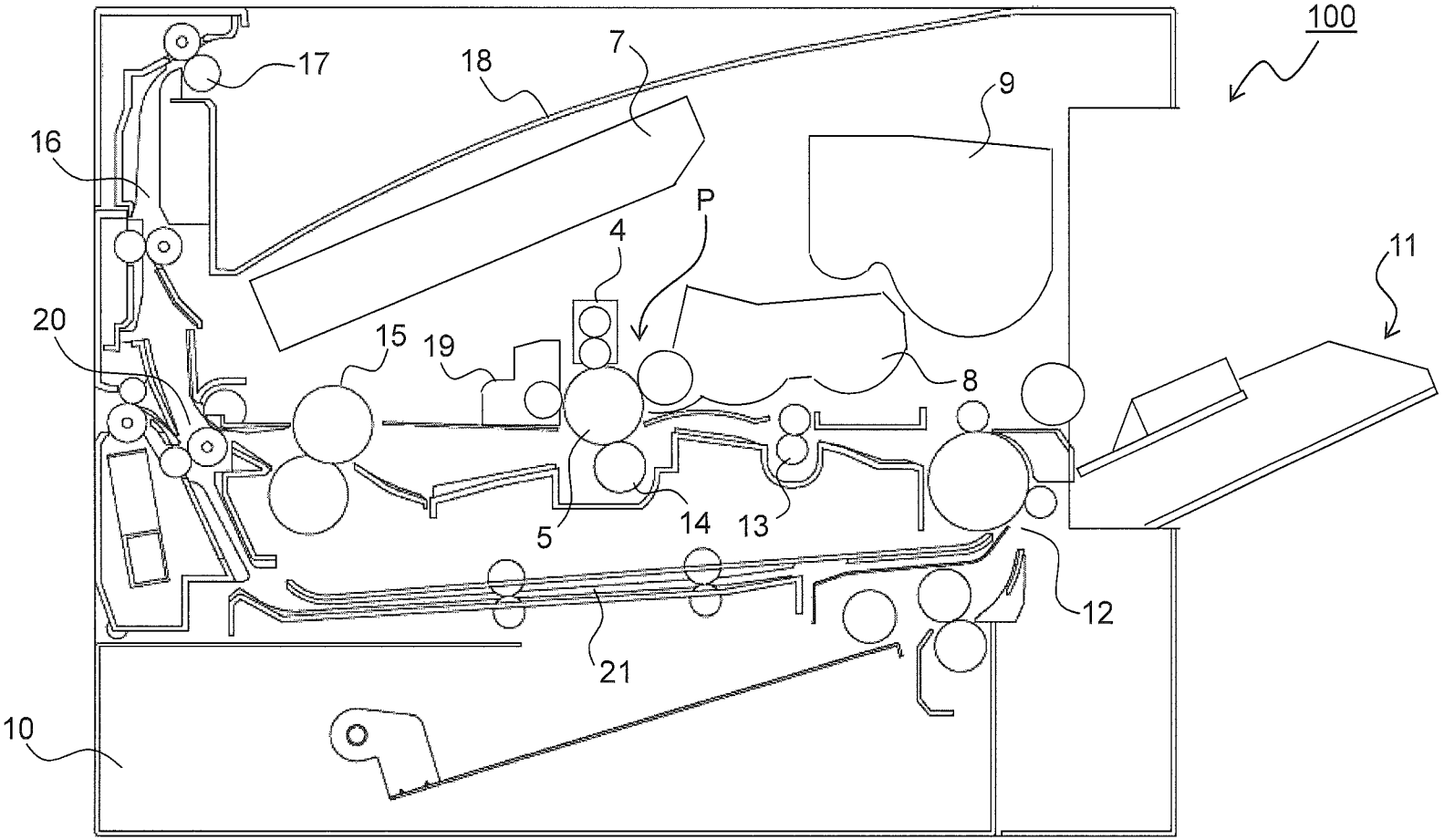
FIG. 1 is a side sectional view showing an internal structure of an image forming apparatus 100 that includes a developing device 15 according to an embodiment of the present disclosure.

Hereinafter, embodiments of the present disclosure will be described with reference to the accompanying drawings. FIG. 1 is a side sectional view showing an internal structure of an image forming apparatus 100 including a fixing device 15 according to an embodiment of the present disclosure. Disposed inside the image forming apparatus (for example, a monochrome printer) 100 is an image forming portion P, which is configured to form a monochrome image through charging, exposure, developing, and transfer processes. In the image forming portion P, along a rotation direction of a photosensitive drum 5 (in a clockwise direction in FIG. 1), there are arranged a charging unit 4, an exposure unit (a laser scanning unit or the like) 7, a developing unit 8, a transfer roller 14, a cleaning device 19, and a charge removing device (not shown).

In an image forming operation, the photosensitive drum 5, which rotates in the clockwise direction, is uniformly charged by the charging unit 4. Next, an electrostatic latent image is formed on the photosensitive drum 5 based on document image data by means of a laser beam from the exposure unit 7. Next, the developing unit 8 makes a developer (hereinafter referred to as toner) adhere to the electrostatic latent image to form a toner image.

Toner supplied to the developing unit 8 is from a toner container 9. Image data is transmitted from a personal computer (not shown), for example. The charge removing device (not shown) which removes residual electric charge from a surface of the photosensitive drum 5 is arranged on a downstream side of the cleaning device 19 with respect to a rotation direction of the photosensitive drum 5.

Toward the photosensitive drum 5 on which the toner image has been formed as described above, a sheet is conveyed from a sheet cassette 10 or a manual sheet feeding device 11 via a sheet conveyance path 12 and a registration roller pair 13. Then, the toner image formed on the surface of the photosensitive drum 5 is transferred onto the sheet by a transfer roller 14 (an image transfer portion). The sheet onto which the toner image has been transferred is separated from the photosensitive drum 5 and conveyed to the fixing device 15 to have the toner image fixed thereon. After passing through the fixing device 15, the sheet is conveyed via a sheet conveyance path 16 to an upper portion of the apparatus, and then, in a case of printing an image just on one side of the sheet (in a case of single-side printing), the sheet is delivered by a delivery roller pair 17 to a delivery tray 18.

On the other hand, in a case of forming an image on each side of the sheet (in a case of double-side printing), after a rear end of the sheet passes through a curved portion 20 of the sheet conveyance path 16, the sheet starts to be conveyed in a reverse direction. Thereby, the sheet is sorted to a reverse conveyance path 21 that branches off from the curved portion 20, turned upside down so that a side thereof on which an image has been formed is reversely faced, and conveyed back to the registration roller pair 13. Then, a next toner image formed on the photosensitive drum 5 is transferred by the transfer roller 14 onto a side of the sheet on which no image has been formed. The sheet onto which the next toner image has been transferred is conveyed to the fixing device 15, where the next toner image is fixed, and then is delivered by the delivery roller pair 17 to the delivery tray 18.

Figure 2:
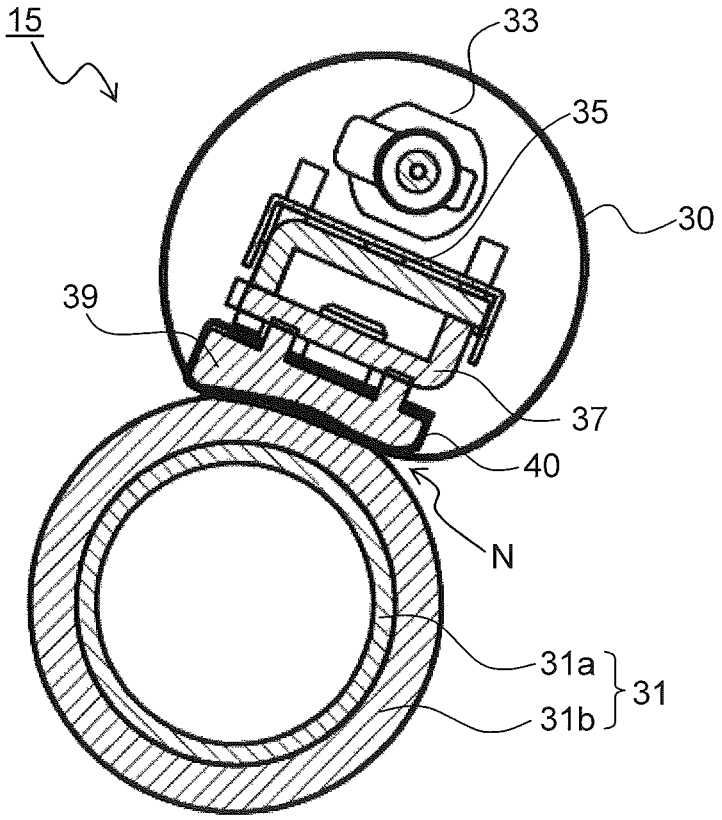
FIG. 2 is a side sectional view showing the fixing device 15 of the present embodiment.
Figure 3:
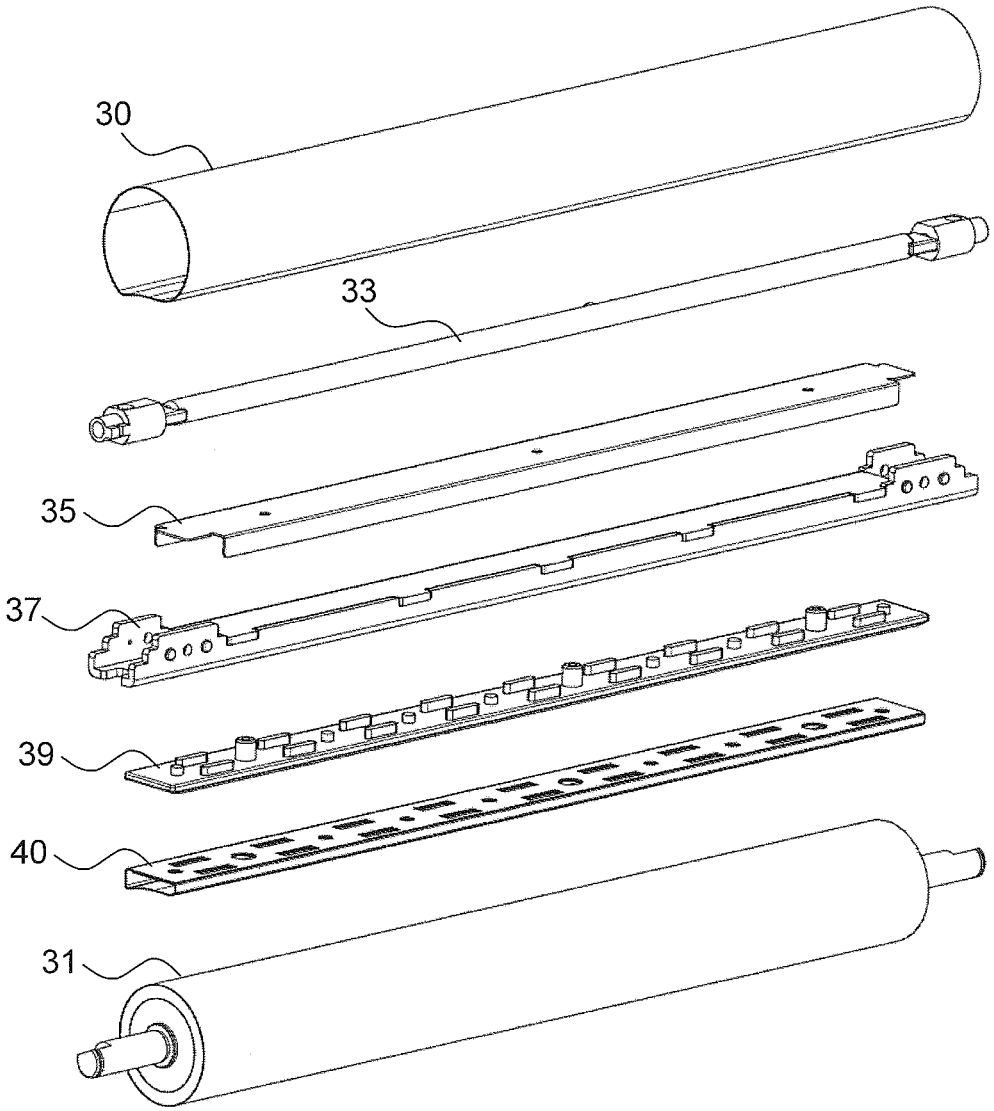
FIG. 3 is an exploded perspective view of a member constituting a fixing nip portion N of the fixing device 15 of the present embodiment.

FIG. 2 is a side sectional view of the fixing device 15 mounted in the image forming apparatus 100. FIG. 3 is an exploded perspective view of a member constituting a fixing nip portion N of the fixing device 15. The fixing device 15 employs a belt fixing method, and includes a fixing belt 30, a pressure roller 31, a heater 33, a reflection plate 35, a support stay 37, a nip plate 39, and a sliding sheet 40. In FIG. 2, illustration of a housing of the fixing device 15 is omitted.

The fixing belt 30 is an endless-shaped belt formed of a plurality of layers stacked on each other including a base layer disposed on an innermost side (a heater-33 side) and a releasing layer disposed on an outermost side (a pressure-roller-31 side). The fixing belt 30 is given a predetermined tension by the nip plate 39 and end portion caps 61 (see FIG. 5).

Used as the base layer is a metal layer formed by plating or rolling a metal such as nickel, or a synthetic resin layer such as a polyimide film. Used for the releasing layer is a fluororesin such as PFA (tetrafluoroethylene-perfluoroalkylvinylether copolymer), and the releasing layer is formed by application of a coating, or by covering with a tube, made of the fluororesin. An appropriate thickness of the releasing layer is 10 to 50 μm when it is formed with a PFA tube, and 10 to 30 μm when it is formed with a fluororesin coating.

Between the base layer and the releasing layer, there may be provided a silicone rubber layer having a thickness of bout 100 to 1000 μm as an elastic layer. With this configuration, the elastic layer covers an unfixed toner image on a sheet, allowing the unfixed toner image to be fixed in a soft way. This makes it possible to achieve a high-quality image, and thus to obtain a high-performance fixing device.

It is also possible to provide a heat storage layer between the base layer and the releasing layer to prevent loss of heat obtained from the heater 33, to thereby uniformize surface temperature of the fixing belt 30. This helps obtain an even higher heating efficiency, and makes it possible to achieve shorter warm-up time and lower power consumption.

The heat storage layer is formed of a silicone rubber containing powder of a metal oxide, such as silica, alumina, and magnesium oxide, as a filler for higher heat conductivity, or the heat storage layer is formed of a highly heat conductive metal such as aluminum, copper, and nickel. The heat storage layer is formed by covering with a tube formed of one of these materials or by plating with one of these materials. Unlike in a case where the heat storage layer is formed of an elastic material such as a silicone rubber, in a case where the heat storage layer is formed of a metal, thickness of the heat storage layer should be carefully set, because a too thick heat storage layer would make the fixing belt 30 disadvantageously rigid and make it impossible to obtain a nip amount necessary to melt the toner. With this in mind, the thickness of the heat storage layer is 10 to 1000 μm, desirably 50 to 500 μm.

Further, a thermistor (not shown) is provided facing an outer circumferential surface of the fixing belt 30. By means of the thermistor, the surface temperature of the fixing belt 30 is detected, and fixing temperature is controlled by turning on/off the heater 33. Here, the surface temperature of the fixing belt 30 is set to 140° C.

The size of the fixing belt 30 in its widthwise direction (a direction perpendicular to the surface of the sheet on which FIG. 2 is drawn) is set to be larger than a width of a largest sheet that can pass through the fixing nip portion N. This makes it possible for the fixing belt 30 to cover the entire surface of a sheet regardless of the size of the sheet, and this helps prevent unfixed toner from adhering to the pressure roller 31 and the nip plate 39.

The pressure roller 31 is constituted by a cylindrical core metal 31*a* formed of a material such as a metal, an elastic layer 31*b* that is formed of a silicone rubber or the like on the core metal 31*a*, and a releasing layer (not shown) formed to cover a surface of the elastic layer 31*b*.

More specifically, the pressure roller 31 used in the present embodiment is constituted by, for example, the core metal 31*a* having an outer diameter of 12 mm, the elastic layer 31*b* formed as a silicone rubber layer having a thickness of 6.5 mm and stacked on the outer circumferential surface of the core metal 31*a*, and the releasing layer that is a tube member formed of PFA (tetrafluoroethylene-perfluoroalkylvinylether copolymer) to cover the elastic layer 31*b*.

The heater 33 is an infrared lamp (a halogen lamp) using a filler gas that is an inert gas to which a minute amount of halogen substance is added, and the heater 33 heats the fixing belt 30 by generating radiant heat. A detailed description will be given later of the configuration of the heater 33. The reflection plate 35 reflects the radiant heat from the heater 33, contributing to efficient heating of the fixing belt 30.

The support stay 37 is formed in a prismatic-tube shape by combining and welding two metal sheets each L-shaped in section to each other. The reflection plate 35 is supported on an upper surface of the support stay 37, and the nip plate 39, which will be described later, is supported on a lower surface of the support stay 37. Each end portion of the support stay 37 is fixed to a housing side panel 15*a* (see FIG. 8) of the fixing device 15.

By being pressed against the pressure roller 31 with the fixing belt 30 therebetween, the nip plate 39 forms the fixing nip portion N through which a sheet is made to pass. Examples of a material of the nip plate 39 include a heat resistant resin such as a liquid crystal polymer and an elastic material such as a silicone rubber, and an elastomer may be disposed on such a surface of the nip plate 39 as faces the fixing belt 30.

The sliding sheet 40 is wrapped around an outer surface of the nip plate 39 in order to reduce sliding loads to contact surfaces (sliding surfaces) of the fixing belt 30 and the nip plate 39. Used as the sliding sheet 40 is a fluororesin sheet such as a PTFE sheet.

The pressure roller 31 is pressed against the fixing belt 30 with a predetermined pressure. When the pressure roller 31 is moved to rotate in a counter-clockwise direction by a motor (not shown), frictional force between the pressure roller 31 and the outer circumferential surface of the fixing belt 30 causes the nip plate 39 (the sliding sheet 40) and an inner circumferential surface of the fixing belt 30 to slide against each other, so that the fixing belt 30 is driven to rotate in the clockwise direction. The fixing nip portion N is formed at where the fixing belt 30 and the pressure roller 31 contact each other while rotating in opposite directions.

A sheet onto which a toner image has been transferred is conveyed from an upstream side in a sheet conveyance direction (the right side in FIG. 2) to the fixing nip portion N, where heat and pressure are applied to the sheet by the fixing belt 30 and the pressure roller 31. Thereby, toner powder on the sheet is melt by the heat to be fixed. After going through the fixing processing, the sheet is released from the surface of the fixing belt 30 by an unillustrated releasing claw, and is then conveyed to a downstream side of the fixing device 15 with respect to the sheet conveyance direction.

Figure 4:
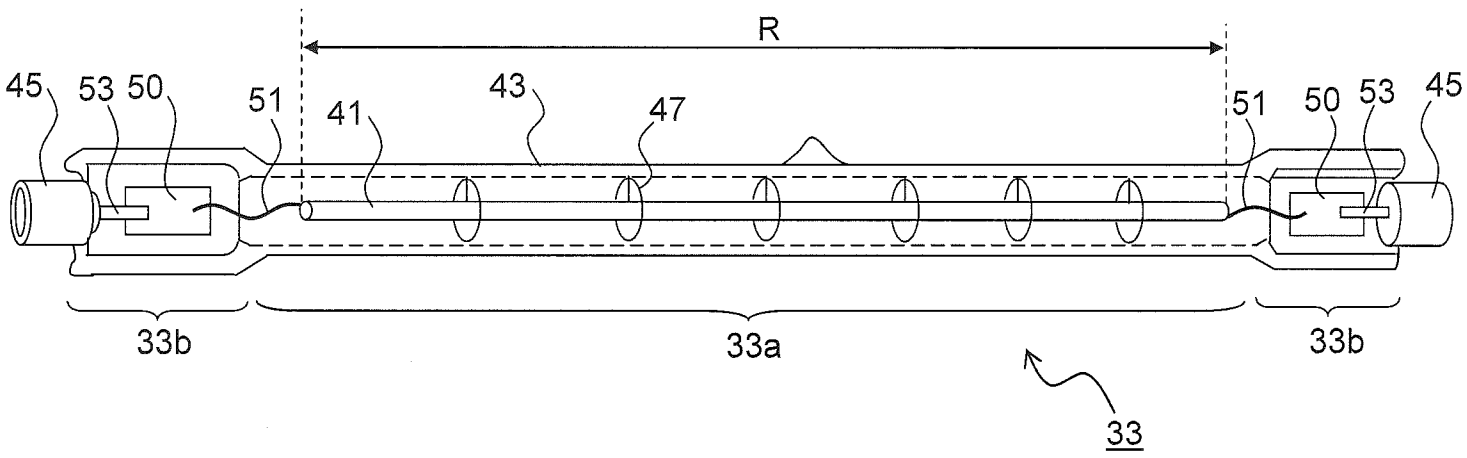
FIG. 4 is a sectional view of a heater 33 used in the fixing device 15 of the present embodiment, shown as being cut in a longitudinal direction of the heater 33.

FIG. 4 is a sectional view of the heater 33 used in the fixing device 15, shown as being cut in its longitudinal direction. The heater 33 has a heat generating portion 33*a* disposed at a center portion of the heater 33 in its longitudinal direction, and a seal portion 33*b* disposed on each side of the heat generating portion 33*a*.

The heat generating portion 33*a* is constituted by a filament 41 as a heat generating body and a cylindrical bulb 43 in which the filament 41 and a filler gas containing an inert gas and halogen are sealed. Inside the bulb 43, a plurality of supporters 47 are disposed at predetermined intervals to support the filament 41. Used as a material of the filament 41 is tungsten having a high melting point and a low evaporation degree. The bulb 43, which is heated to a high temperature by cyclic regeneration reaction (halogen cycle) that occurs between the sealed halogen and tungsten that is heated to evaporate, is made of silica glass as a material which is excellent in heat resistance. In the heat generating portion 33*a*, a region in which the filament 41 is disposed is a light emitting region (heat generating region) R.

The seal portion 33*b* is a portion that seals the bulb 43 and a base 45 to which an external electric wire 55 (see FIG. 5) is connected. Inside the seal portion 33*b*, there is disposed a molybdenum foil 50 having a knife edge and having a thickness of 20 to 30 μm, and the molybdenum foil 50 is pinch-sealed with an internal lead wire 51 extending from the filament 41 and an external lead rod 53 extending from the base 45 connected to the molybdenum foil 50.

Figure 5:
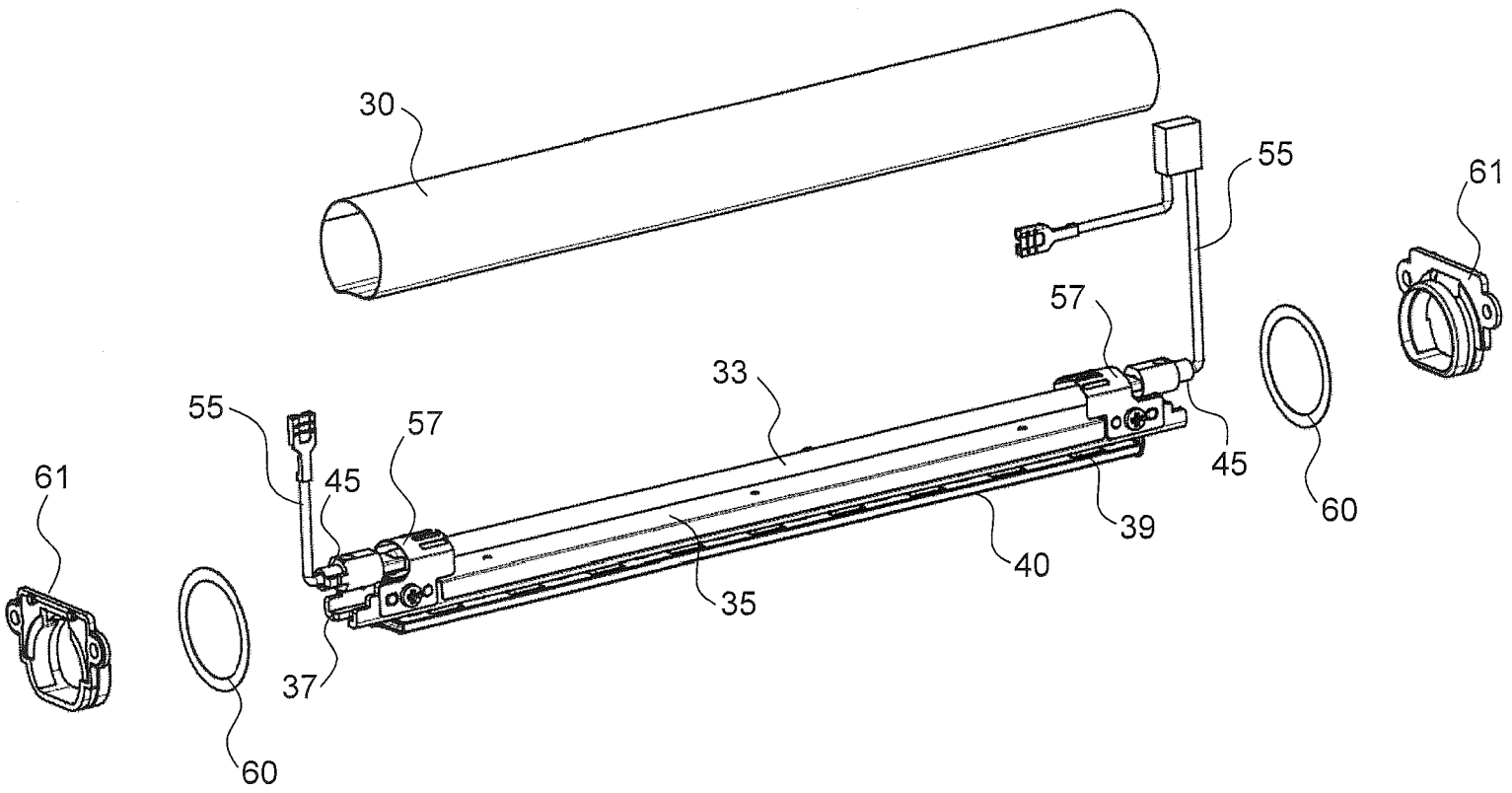
FIG. 5 is a perspective view of members constituting the fixing nip portion N of the fixing device 15 of the present embodiment in the middle of assembly.

Next, a description will be given of steps of assembling members constituting the fixing nip N of the fixing device 15 of the present embodiment. FIG. 5 is a perspective view showing a state where members to be disposed inside the fixing belt 30 have been assembled. For convenience of description, however, FIG. 5 shows a state where the fixing belt 30, end portion rings 60, and the end portion caps 61 are removed. First, the reflection plate 35 is attached to the upper surface of the support stay 37 and the nip plate 39 around which the sliding sheet 40 is wrapped is attached to the lower surface of the support stay 37. Next, to each end portion of the support stay 37, an end-portion excessive temperature increase prevention cap 57 is attached. Further, the external electric wire 55 is connected to the base 45 at each end portion of the heater 33.

Next, the support stay 37 to which the reflection plate 35, the nip plate 39, and the end-portion excessive temperature increase prevention cap 57 are attached is inserted into the fixing belt 30. Thereafter, a pair of the end portion rings 60 and a pair of the end portion caps 61, which rotatably support the end portion rings 60, are attached. Finally, the heater 33 is inserted into a gap between the fixing belt 30 and the reflection plate 35, and the assembly of each member to be disposed inside the fixing belt 30 is completed as shown in FIG. 5.

In a case where the end-portion excessive temperature increase prevention cap 57 is attached to each end portion of the heater 33 as shown in FIG. 5, excessive increase in temperature due to radiant heat from the heater 33 is reduced at each end portion of the fixing belt 30 in its widthwise direction, but heat accumulates inside the end-portion excessive temperature increase prevention cap 57 to cause increase in temperature at each end portion of the heater 33.

The molybdenum foil 50 (see FIG. 4) used in the seal portion 33*b* of the heater 33 is not necessarily kept completely out of contact with external air, but the molybdenum foil 50 contacts external air via a minute gap between the silica glass and the external lead rod 53. Molybdenum is highly susceptible to oxidation, and the molybdenum foil 50 starts to be oxidized and thus starts to increase in volume at a high temperature of about 350° C. Then, when the increase in volume of the molybdenum foil 50 reaches an amount too large for the silica glass sealing the seal portion 33*b* to endure, breakage occurs in the seal portion 33*b* and a tear is caused in the molybdenum foil 50.

Figure 6:
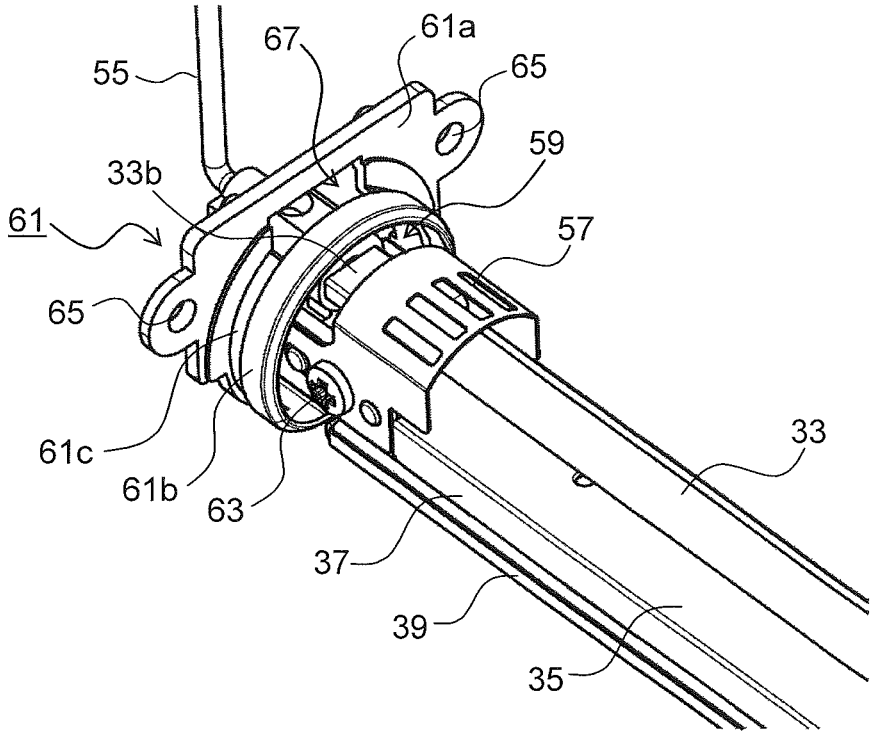
FIG. 6 is a perspective view of around an end portion of the heater 33 to which an end-portion excessive temperature increase prevention cap 57 is attached.
Figure 7:
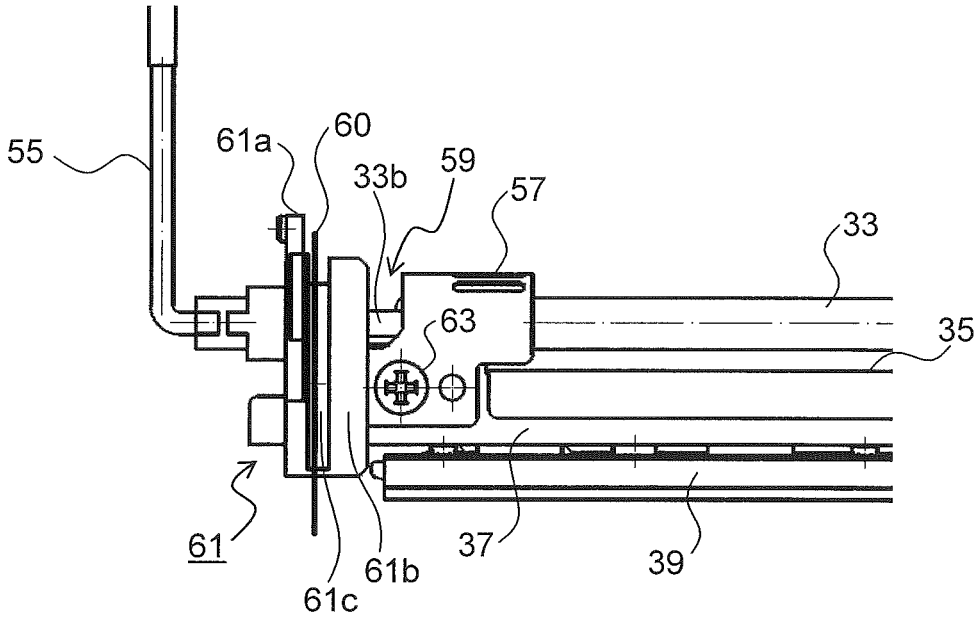
FIG. 7 is a side view of around the end portion of the heater 33 to which the end-portion excessive temperature increase prevention cap 57 is attached.
Figure 8:
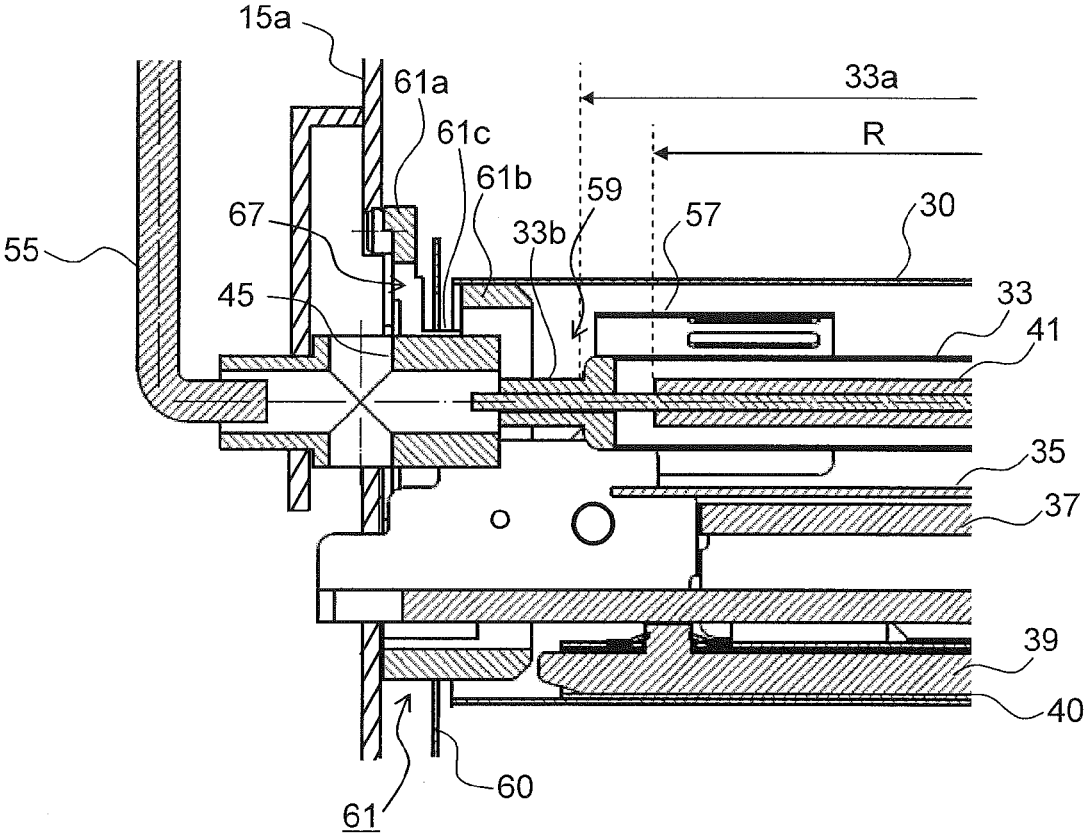
FIG. 8 is a side sectional view of around the end portion of the heater 33 to which the end-portion excessive temperature increase prevention cap 57 is attached.

To prevent these inconveniences, in the present embodiment, temperature increase is reduced in the vicinity of the seal portion 33*b* of the heater 33 by appropriately designing the shape of the end-portion excessive temperature increase prevention cap 57. FIG. 6 and FIG. 7 are a perspective view and a side view, respectively, of around one of the end portions of the heater 33 to which the end-portion excessive temperature increase prevention cap 57 is attached. FIG. 8 is a side sectional view of around the one of the end portions of the heater 33 to which the end-portion excessive temperature increase prevention cap 57 is attached. Here, FIGS. 6 to 8 shows a configuration of around one end portion (the left end portion in FIG. 5) of the heater 33, but this configuration applies also to around the other end portion (the right end portion in FIG. 5) of the heater 33.

The end-portion excessive temperature increase prevention cap 57 is made of metal, and is fixed to a side surface of the support stay 37 with a screw 63 as shown in FIGS. 6 to 8. Also, a first opening portion 59 is formed in such part of the end-portion excessive temperature increase prevention cap 57 as faces the seal portion 33*b*.

The end portion ring 60 in the figures is one of a pair of end portion rings 60 each disposed outside each end of the fixing belt 30 in its widthwise direction. A distance between the pair of end portion rings 60 is set to be substantially equal to the size of the fixing belt in its widthwise direction, and leaning (meandering) of the fixing belt 30 is prevented by a side edge of the fixing belt 30 hitting either one of the end portion rings 60.

The end portion caps 61 are made of a heat resistant resin, and each have a main body portion 61*a* that is fixed to the housing side panel 15*a* of the fixing device 15, a belt support portion 61*b* that is formed inside the main body portion 61*a* in the widthwise direction of the fixing belt 30, and a groove-shaped ring support portion 61*c* that is formed between the main body portion 61*a* and the belt support portion 61*b* and that rotatably supports the end portion ring 60. In the main body portion 61*a*, there is formed a screw hole 65 for fixing the end portion cap 61 to the housing side panel 15*a* with a screw. A second opening portion 67 is formed in such part of the main body portion 61*a* and the ring support portion 61*c* as faces an upper portion of the heater 33.

The formation of the first opening portion 59 in the end-portion excessive temperature increase prevention cap 57 makes it difficult for heat to stay around the seal portions 33*b* of the heater 33, which reduces increase in temperature of the seal portions 33*b*, to thereby reduce increase in volume of the molybdenum foil 50 disposed inside the seal portion 33*b* resulting from oxidation of the molybdenum foil 50. This helps effectively reduce breakage of the seal portion 33*b*, and contributes to longer life of the heater 33.

A gap is formed, by the first opening portion 59, between the end-portion excessive temperature increase prevention cap 57 and the end portion cap 61 made of resin, and this makes it difficult for heat to transfer from the end-portion excessive temperature increase prevention cap 57, which is heated to a temperature as high as 500° C., to the end portion cap 61. As a result, the temperature of the end portion cap 61 is lower than in a conventional configuration where no first opening portion 59 is provided, and this eliminates the need of using expensive heat resistant resin as a material of the end portion cap 61, and thus leads to a lower cost.

The seal portion 33*b* is disposed outside the heat generating portion 33*a* (the light emitting region R) of the heater 33. Thus, even with the first opening portion 59 formed in such part of the end-portion excessive temperature increase prevention cap 57 as faces the seal portion 33*b*, there is no need for concerns about increase in temperature of the fixing belt 30.

Figure 9:
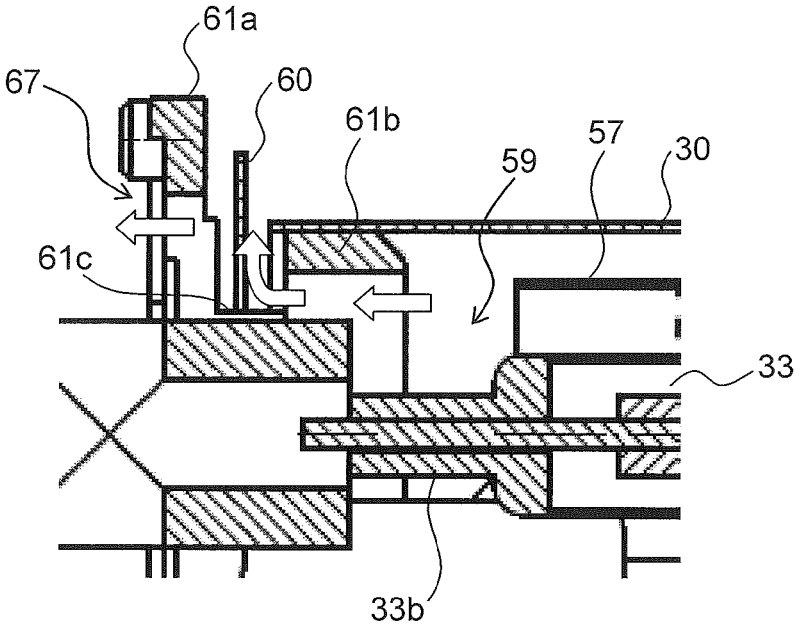
FIG. 9 is an enlarged view of part around a first opening portion 59 and a second opening portion 67 shown in FIG. 8.

Further, the second opening portion 67 formed in such part of the end portion cap 61 as faces the heater 33, makes it more difficult for heat to stay around the seal portions 33*b*. FIG. 9 is an enlarged view of part around the first opening portion 59 and the second opening portion 67 shown in FIG. 8. As shown in FIG. 9, the second opening portion 67 is formed to communicate with the first opening portion 59. Thereby, as indicated by white arrows in FIG. 9, it is possible to allow heated air around the seal portion 33*b* to escape via the first and second opening portions 59 and 67 to outside the housing side panel 15*a*.

Here, the belt support portion 61*b* of the end portion cap 61 needs to have a function of supporting the whole of the inner circumferential surface of the fixing belt 30 which is prone to deformation. On the other hand, even when partly broken, the ring support portion 61*c* is able to rotatably support the end portion ring 60. Thus, the second opening portion 67 is not formed in an outer circumferential surface of the belt support portion 61*b*, but is formed in such part of the end portion cap 61 as is exterior to the outer circumferential surface of the belt support portion 61*b* in the widthwise direction of the fixing belt 30, that is, the second opening portion 67 is formed in the main body portion 61*a* and the ring support portion 61*c*.

It should be understood that the present disclosure is not limited to the above embodiments, and various modifications are possible within the scope of the present disclosure. For example, the configurations of the fixing belt 30, the pressure roller 31, the support stay 37, and the nip plate 39, etc. illustrated in the above-described embodiment are preferable examples, and it is possible to adopt other configurations that enable the object of the present disclosure to be achieved.

Furthermore, the present disclosure is not limited to monochrome printers as shown in FIG. 1, but is certainly applicable to other types of image forming apparatuses provided with a fixing device that employs a belt fixing method, such as a color printer, monochrome and color copiers, a digital multifunction peripheral, and a facsimile.

The present disclosure is usable in a fixing device that employs a belt fixing method where a sheet carrying an unfixed toner image thereon is passed through a fixing nip portion, which is formed by a heated fixing belt and a pressure member, and the unfixed toner is heated and melted to be fixed on the sheet. The present disclosure makes it possible to provide a fixing device that is capable of reducing excessive temperature increase in a non-paper-passing region of a fixing belt and preventing breakage of a heater disposed inside the fixing belt.

What is claimed is:

1. A fixing device comprising:

a fixing belt that is endless shaped and circularly movable at a speed substantially equal to a recording medium conveying speed;

a heater that is disposed inside the fixing belt, that has a heat generating portion in which a filler gas and a filament are sealed and a seal portion that seals each end of the heat generating portion, and that heats the fixing belt with radiant heat from the heat generating portion;

a holding member that is disposed inside the fixing belt and slides against an inner circumferential surface of the fixing belt;

a pressure member that is pressed with a predetermined pressure against the holding member with the fixing belt therebetween such that a fixing nip is formed between the fixing belt and the pressure member; and an end-portion excessive temperature increase prevention member that is attached to each end portions of the heater, that blocks transfer of radiant heat toward each end portion of the fixing belt in a widthwise direction of the fixing belt, and that has a first opening portion formed in such part thereof as faces the seal portion of the heater, a recording medium being passed through the fixing nip portion to fix an unfixed toner image carried on the recording medium, wherein at the each end portion of the fixing belt in the widthwise direction thereof, an end portion ring that prevents the fixing belt from meandering, and an end portion cap that rotatably supports the end portion ring are disposed outside the end-portion excessive temperature increase prevention member in the widthwise direction of the fixing belt, and the first opening portion forms a gap between the end portion cap and the end-portion excessive temperature increase prevention member.

2. The fixing device according to claim 1, wherein the end portion cap has a second opening portion formed therein to communicate with the first opening portion.

3. The fixing device according to claim 2, wherein the end portion cap has a belt support portion that slidably supports the each end portion of the fixing belt in the widthwise direction thereof, and a ring support portion that is formed outside the belt support portion in the widthwise direction of the fixing belt and that rotatably supports the end portion ring, and the second opening portion is formed outside the belt support portion in the widthwise direction of the fixing belt.

4. The fixing device according to claim 1, wherein a molybdenum foil is disposed and sealed inside the seal portion, with an internal lead member extending from the filament and an external lead member extending from outside the seal member connected to the molybdenum foil.

5. An image forming apparatus comprising the developing device according to claim 1.

* * * * *